US006952186B2

(12) United States Patent
Saito et al.

(10) Patent No.: US 6,952,186 B2
(45) Date of Patent: Oct. 4, 2005

(54) ANTENNA

(75) Inventors: Tetsuya Saito, Kodama-gun (JP); Sumio Hiraku, Fuchu (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/191,625

(22) Filed: Jul. 10, 2002

(65) Prior Publication Data

US 2003/0011531 A1 Jan. 16, 2003

(30) Foreign Application Priority Data

Jul. 11, 2001 (JP) ..... 2001-210179

(51) Int. Cl.[7] ..... H01Q 1/24
(52) U.S. Cl. ..... 343/702; 343/895
(58) Field of Search ..... 343/702, 895, 343/900, 901; H01Q 1/24

(56) References Cited

U.S. PATENT DOCUMENTS 4,868,576 A * 9/1989 Johnson, Jr. ..... 343/702
5,504,494 A * 4/1996 Chatzipetros et al. ..... 343/702
5,754,146 A * 5/1998 Knowles et al. ..... 343/895
5,771,023 A 6/1998 Engblom
5,923,305 A * 7/1999 Sadler et al. ..... 343/895
5,982,330 A * 11/1999 Koyanagi et al. ..... 343/702
6,163,300 A * 12/2000 Ishikawa et al. ..... 343/702
6,388,625 B1 * 5/2002 Fukushima et al. ..... 343/702
6,404,392 B1 * 6/2002 Blom ..... 343/702

FOREIGN PATENT DOCUMENTS

| | | |
|---|---|---|
| JP | 10-22730 A | 1/1998 |
| JP | 11-186823 A | 7/1999 |
| WO | WO 99/26314 A1 | 5/1999 |
| WO | WO 01/11721 A1 | 2/2001 |

* cited by examiner

*Primary Examiner*—Hoanganh Le
(74) *Attorney, Agent, or Firm*—Sughrue Mion, PLLC

(57) ABSTRACT

A helical antenna capable of operating at a plurality of different resonant frequencies. The helical antenna has a first helical antenna element, a second helical antenna element arranged coaxially with the first helical antenna element and coupled to the first helical antenna element through capacitive coupling, and a metal connection directly connected only to the first helical antenna element to fed the helical antenna. The first helical antenna element is fed through one end thereof to function as a quarter-wave antenna. The second helical antenna element is fed through capacitive coupling to function as a half-wave antenna.

19 Claims, 6 Drawing Sheets

ANTENNA

BACKGROUND OF THE INVENTION

1. Field of the Invention

The present invention relates to an antenna suitable for use in a portable radio device and the like, and more particularly, to an antenna which resonates at a plurality of frequencies.

2. Description of the Related Art

A portable radio device represented by a portable telephone device or a cellular telephone device has an antenna mounted on the top of its housing, to radiate or capture radio waves through the antenna for transmission and reception operations. A portable telephone is provided with an antenna which is made up of an upper helical antenna and a lower whip antenna (or rod antenna). The antenna is arranged telescopically to and from a housing, such that a gain is increased when the antenna is extended, while the antenna protrudes less from the housing when it is retracted. Also, some recent portable telephones support a plurality of radio communication systems, and an antenna used in such a portable telephone must have characteristics of resonating in a plurality of frequency bands.

As an antenna which resonates in a plurality of frequency bands and can operate in these frequency bands, Japanese Patent Laid-open Application No. 10-22730 (JP, 10022730, A), for example, discloses a helical antenna which has coaxially arranged windings spirally wound at different winding pitches, as illustrated in FIG. 1A. In the helical antenna illustrated in FIG. 1A, first helical antenna element 91 and second helical antenna element 92, each of which is formed by helically wounding a conductive wire, are accommodated in cover 93. First helical antenna element 91 has a smaller winding pitch than second helical antenna element 92. These antenna elements 91, 92 are coaxially arranged, and connected respectively to mounting metal fixture 93 at one end thereof. FIG. 1B illustrates an equivalent circuit of this conventional helical antenna, where first helical antenna element 91 is connected directly to second helical antenna element 92, and both helical antenna elements 91, 92 are fed by feeding unit 90.

With a helical antenna, a winding pitch and the number of turns are varied for adjusting the characteristics of the antenna. For example, a wider winding pitch results in a wider bandwidth at a resonant frequency. In this event, if the winding pitch is varied without changing the overall length of the antenna, the number of turns is changed, leading to a change in an electric length of the antenna element, and an eventual change in the resonant frequency. Moreover, in the helical antenna illustrated in FIGS. 1A and 1B, two helical antenna elements 91, 92 are directly connected by an electric conductor, that is, they are connected through a DC (direct current) path, so that if one of the helical antenna elements is varied in structure (the winding pitch and/or number of turns) to change the antenna characteristics, this causes a change in the characteristics of the other helical antenna element, with the result that difficulties are encountered in adjusting both elements to respective optimal characteristics.

Also, in the conventional helical antenna, each helical antenna element 91, 92 is always connected to the feeding unit at one end thereof, so that it resonates with a quarter wavelength. Therefore, for resonating the helical antenna in different resonant modes, a matching circuit must be provided for each frequency. When this helical antenna is attached to a leading end of a rod antenna, this antenna can be applied only at frequencies which are in a particular relationship. As a specific example, where the wavelength is represented by λ, the helical antenna can be applied only to an antenna which resonates at λ/4 for frequency of 1.5 GHz and at 3λ/8 for frequency of 1.9 GHz. Particularly, when one frequency is substantially twice as high as the other frequency, the half wavelength resonance condition is difficult to realize at any frequency because the antenna element is powered from one end thereof.

SUMMARY OF THE INVENTION

It is therefore an object of the present invention to provide an antenna which has a plurality of helical antenna elements with improved antenna characteristics.

It is another object of the present invention to provide an antenna which is capable of operating in any of a plurality of frequency bands, the frequency ratio of which is substantially two.

According an aspect of the present invention, provided is an antenna which has a first helical antenna element, a second helical antenna element arranged coaxially with the first helical antenna element, and coupled to the first helical antenna element through capacitive coupling, and a connection directly connected only to the first helical antenna element for feeding the antenna, wherein the second helical antenna element is fed through the capacitive coupling.

In other words, the connection is connected for DC (direct current) operation only to the first helical antenna element. Here, to be connected for DC operation means that associated elements are electrically and mechanically connected by an electric conductor, so that a direct current can flow therebetween.

In the helical antenna as described above, since the connection is directly connected only to the first helical antenna, the first helical antenna element and second helical antenna element can be relatively weekly coupled to each other, so that a change in structure (a winding pitch and/or the number of turns) of one helical antenna element will not significantly affect the characteristics of the other helical antenna element. As a result, the helical antenna elements can be modified in structure independently of each other to facilitate adjustments of the characteristics of the two helical antenna elements, thereby readily providing an antenna which satisfactorily operates at two frequencies.

Preferably, in the antenna of the present invention, the first helical antenna element is fed from one end thereof, while the second helical antenna element is opened at both ends thereof. As a result, the first helical antenna element can resonate with approximately a quarter wavelength (λ/4), while the second helical antenna element can resonate with approximately half wavelength (λ/2). Further, according to this structure, appropriate matching can be achieved at both frequencies, so that it is possible to provide an antenna which satisfactorily operates at both frequencies even when a first resonant frequency is substantially an integer multiple of a second resonant frequency.

According to another aspect of the present invention, provided is an antenna which has a rod antenna which can be at least partially retracted into a housing; a helical antenna disposed at an upper end of the rod antenna and electrically insulated from the rod antenna; and a first connection disposed at a lower end of the rod antenna, wherein the helical antenna comprises a first helical antenna element; a second helical antenna element arranged coaxially with the first helical antenna element, and coupled to the first helical antenna element through capacitive coupling; and a second connection directly connected only to the first helical antenna element for feeding the helical antenna, the antenna is fed through the first connection when the rod antenna is extended from the housing, and fed through the second connection when the rod antenna is retracted in the housing, and the second helical antenna element is fed through the capacitive coupling.

The above and other objects, features, and advantages of the present invention will become apparent from the following description with reference to the accompanying drawings, which illustrate examples of the present invention.

DETAILED DESCRIPTION OF THE INVENTION

Figure 1A:
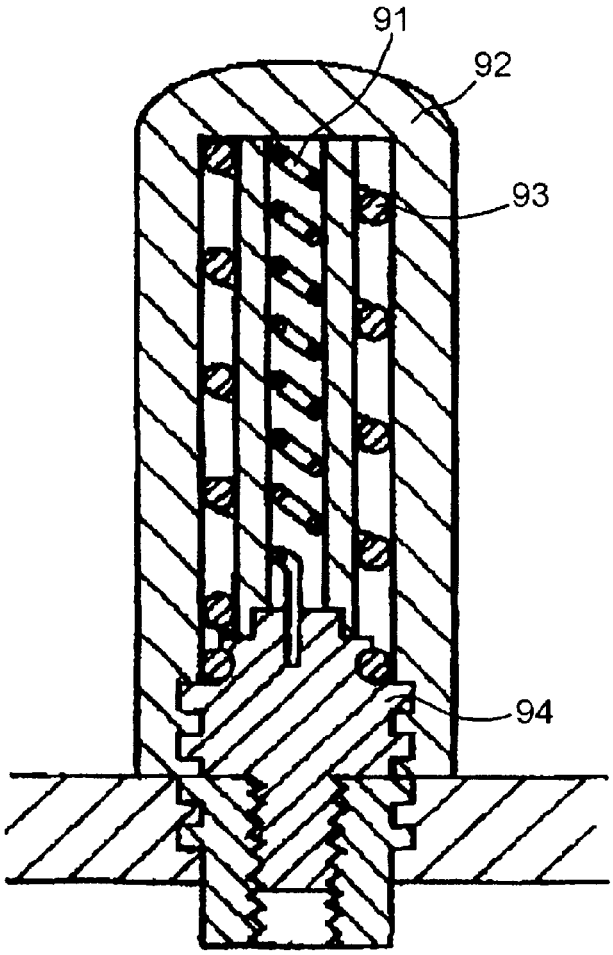
FIG. 1A (BACKGROUND ART)
FIG. 1A is a cross-sectional view of a conventional helical antenna which supports two frequency bands.
Figure 1B:
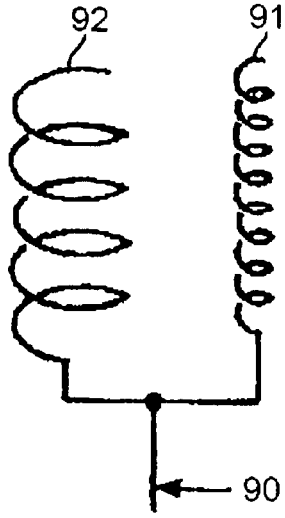
FIG. 1B (BACKGROUND ART)
FIG. 1B is an equivalent circuit diagram of the helical antenna illustrated in FIG. 1A.
Figure 2:
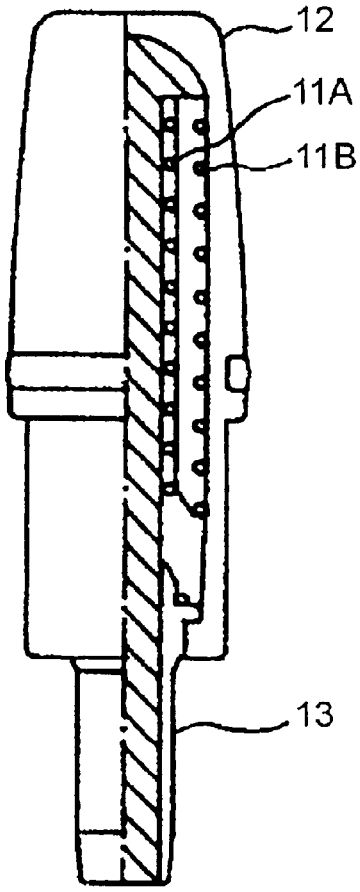
FIG. 2 is a partially sectioned front view of a helical antenna according to a first embodiment of the present invention.

A helical antenna according to a first embodiment of the present invention illustrated in FIG. 2 comprises first coil element 11A and second coil element 11B each of which is formed by helically winding a conductive wire. Second coil element 11B is arranged outside of first coil element 11A and coaxially with first coil element 11A. Coil elements 11A, 11B are both fabricated as helical antenna elements. Therefore, both coil elements 11A, 11B are wound at different diameters when they are formed into helical antennas. In FIG. 2, a portion to the left of a one-dot chain line shows an outer appearance of the helical antenna, while a portion to the right of the one-dot chain line shows a cross-sectional view of the same.

In the illustrated helical antenna, first coil element 11A has an electric length to resonate at first resonant frequency ($f_L$) with one end thereof functioning as a feeding point. Second coil element 11B is open at both ends, and has an electric length to resonate at second resonant frequency ($f_H$) which is generally higher than first resonant frequency ($f_L$).

Cover 12 made of synthetic resin is disposed outside of coil elements 11A, 11B. First coil element 11A is spaced apart by second coil element 11B such that both coil elements are coupled to each other through capacitive coupling so that an RF (radio frequency) signal can be fed from first coil element 11A to second coil element 11B through the capacitive coupling.

Metal fixture 13 is disposed below cover 12. Metal fixture 13 is directly connected to first coil element 11A, and is electrically connected to a transceiver of a portable radio device to function as a feeding metal fixture for supplying an RF signal to coil elements 11A, 11B. In other words, metal fixture is connected for DC operation to first coil element 11A. To be connected for DC operation, herein used, means that associated elements are electrically and mechanically connected by a conductor, so that a direct current can flow therebetween. Second coil element 11B is not connected to metal fixture 13 for DC operation.

In this embodiment, inner first coil element 11A is would at a winding pitch smaller than outer second coil element 11B, as illustrated. However, the relationship in winding pitch between both elements is not limited to the illustrated one, but in alternatives, first coil element 11A may be wound at a larger winding pitch, or both coil elements may be wound at the same winding pitch.

Next, description will be made on the operation of the helical antenna illustrated in FIG. 2.

In this helical antenna, first coil element 11A is connected to metal fixture 13 and fed therethrough. Second coil element 11B, though not connected directly to metal fixture 13, is connected to first coil element 11A through capacitive coupling, so that it is fed through metal fixture 13 and first coil element 11A.

At first resonant frequency ($f_L$), since first coil element 11A disposed inside has an electric length to resonate at this first resonant frequency ($f_L$), and is fed from metal fixture 13 connected to one end thereof, the helical antenna operates as a quarter-wave antenna. While second coil element 11B is disposed outside of first coil element 11A to provide capacitive coupling therebetween, second coil element 11B is designed to resonate at second resonant frequency ($f_H$), so that second coil element 11B has a larger impedance at first resonant frequency ($f_L$). Thus, at first resonant frequency ($f_L$), no sufficient RF current flows through second coil element 11B to cause the same to operate as a radiating conductor, so that second coil element 11B remains inoperative.

At second resonant frequency ($f_H$), on the other hand, second coil element 11B disposed outside has an electric length to resonate at this second resonant frequency ($f_H$), and has both ends opened, so that the helical antenna operates as a half-wave antenna. In this event, while second coil element 11B is not connected directly to feeding metal fixture 13, second coil element 11B is coupled through capacitive coupling to first coil element 11A which is connected directly to metal fixture 13, so that an RF current supplied to metal fixture 13 is fed to second coil element 11B through first coil element 11A. In other words, an RF current at second resonant frequency ($f_H$) is supplied to second coil element 11B. Since first coil element 11A is designed to resonate at first resonant frequency ($f_L$), it has a larger impedance at second resonant frequency ($f_H$). Thus, at second resonant frequency ($f_H$), no sufficient RF current flows through first coil element 11A to cause the same to operate as a radiating conductor, so that first coil element 11A remains inoperative.

In the foregoing description, first coil element 11A connected directly to feeding metal fixture 13 is disposed inside, and second coil element 11B not connected directly to metal fixture 13 is disposed outside. Alternatively, first coil element 11A connected directly to metal fixture 13 may be disposed outside, with second coil element 11B not connected directly to metal fixture 13 disposed inside.

In the foregoing helical antenna, first coil antenna 11A and second coil antenna 11B interact through relatively week coupling, i.e., capacitive coupling, so that a change in structure, a winding pitch and/or the number of turns of one coil element, will not significantly affect the characteristics of the other coil element. Therefore, the resulting antenna in the aforementioned structure facilitates adjustments of the characteristics of the respective coil elements, and satisfactorily operates at two frequencies. Also, since second coil element 11B resonates through an interaction with first coil element 11A, the electric length of second helical antenna 11B may be increased at second resonant frequency ($f_H$) to bring the resonance conditions of both closer to each other.

Further, in the foregoing helical antenna, first coil element 11A resonates at first resonant frequency ($f_L$) with approximately a quarter wavelength, while second coil element 11B resonates at second resonant frequency ($f_H$) with approximately a half wavelength, so that appropriate matching can be provided at both frequencies, even if first resonant frequency ($f_L$) is substantially an integer multiple of second resonant frequency ($f_H$). Thus, the resulting antenna operates satisfactorily at two frequencies.

Next, description will be made on a whip antenna according to a second embodiment of the present invention.

Figure 3:
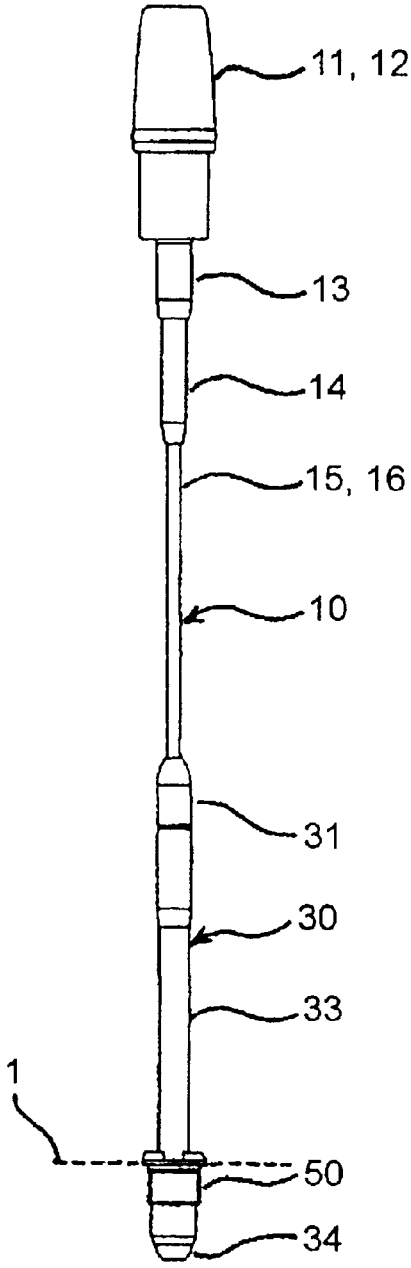
FIG. 3 is a front view generally illustrating a whip antenna according to a second embodiment of the present invention.

The whip antenna according to the second embodiment illustrated in FIG. 3 is a telescopical whip antenna which has a rod antenna disposed below the helical antenna in the aforementioned first embodiment. Specifically, this whip antenna is a so-called two-stage telescopical whip antenna which is made up of upper element 10, and lower element 30 disposed below upper element 10. Upper element 10 is electrically and mechanically connected to lower element 30 through a joint metal fixture 31 fixed at a leading end of lower element 30, and upper element 10 can be retracted into lower element 30. A helical antenna (i.e., coil element 11) is further disposed at a leading end of upper element 10. The aforementioned helical antenna in the first embodiment is used as this helical antenna.

First, upper element 10 and coil element 11 will be described. Upper element 10 mainly comprises rod conductor 15 which is preferably formed of a superelastic alloy. By applying a superelastic alloy to rod conductor 15, resulting upper element 10 is resistant to deformation by a bending stress. Rod conductor 15 is covered with insulating tube 16 made of synthetic resin around the periphery to prevent exposure of rod conductor 15 which makes up a conductive metal element.

Figure 4:
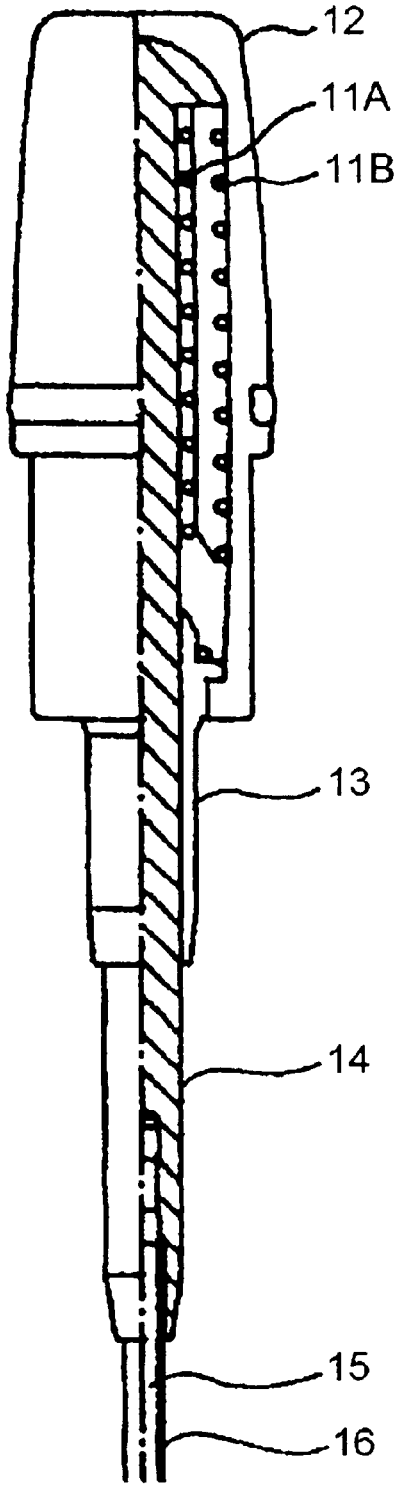
FIG. 4 is a partially sectioned front view of a leading end portion of the whip antenna illustrated in FIG. 3.

At an upper end of upper element 10, coil element 11 is provided as a helical antenna. As described above, coil element 11 has first coil element 11A and second coil element 11B accommodated in cover 12 which is made of synthetic resin. FIG. 4 illustrates this helical antenna, wherein a portion to the right of a one-dot chain line is a cross-sectional view.

In the helical antenna, first and second coil elements 11A, 11B, which are respectively helical antenna elements, are arranged coaxially with each other. First coil element 11A disposed inside has an electric length to resonate at first resonant frequency ($f_L$), with one end thereof functioning as a feeding point. Second coil element 11B disposed outside is open at both ends, and has an electric length to resonate at second resonant frequency ($f_H$) which is generally higher than first resonant frequency ($f_L$). Here, inner first coil element 11A is would at a winding pitch smaller than outer second coil element 11B. However, the relationship in winding pitch between both elements is not limited to the illustrated one, but in alternatives, first coil element 11A may be wound at a larger winding pitch, or both coil elements may be wound at the same winding pitch.

Metal fixture 13 larger in diameter than upper element 10 is disposed below cover 12. In other wards, helical antenna (coil element 11) is made up of first coil element 11A, second coil element 11B, cover 12 made of synthetic resin, and metal fixture 13. Metal fixture 13, which is connected to coil element 11, is in contact with support 50 attached to housing 1 of a portable radio device, when the antenna is retracted, to function as a feeding metal fixture for supplying an RF signal to coil element 11. Specifically, metal fixture 13 is connected to a lower end of first coil element 11A for DC operation, such that first coil element 11A is directly fed through metal fixture 13 when the antenna is retracted. Second coil element 11B, though not connected to metal fixture 13 for DC operation, is positioned outside of first coil element 11A in close proximity, so that it is coupled to first coil element 11A through capacitive coupling. Therefore, second coil element 11B is fed through metal fixture 13 and first coil element 11A by capacitive coupling.

Joint 14 made of synthetic resin is disposed inside of metal fixture 13 for insulating rod conductor 15 from metal fixture 13 but fixing both components. In other words, coil element 11 and rod conductor 15 (rod antenna) are insulated and mechanically connected by joint 14.

In the second embodiment, first coil element 11A connected directly to metal fixture 13 is disposed inside, while second coil element 11B not connected directly to metal fixture 13 is disposed outside. Alternatively, first coil element connected directly to metal fixture 13 may be disposed outside, and second coil element not connected directly to metal fixture may be disposed inside.

Next, lower element 30 will be described.

Lower element 30 is made of a metal wire spirally wound to form a hollow cylindrical element. In addition, upper element 10 is slid up and down within lower element 30 so that upper element can extend from and retract into lower element 30 with a lower end of upper element 10 in contact with an inner wall of lower element 30. In this manner, rod antenna 15 is implemented through an electric contact established between rod conductor 15 of upper element 10 and lower element 30.

The wire making up lower element 30 has an oval shape in cross section, with its major diameter oriented in a direction in which the whip antenna is extended and retracted (the minor diameter is oriented in a radial direction of the object) such that lower element 30 has a smaller outer diameter and a larger inner diameter while ensuring a sufficient strength of the whip antenna without reducing the cross-sectional area of the wire. The periphery of lower element 30 is covered with tube 33 made of synthetic resin having an insulating property to prevent the electrically conductive wire from exposing.

Joint metal fixture 31, which is secured to an upper end of lower element 30, abuts to a washer attached below upper element 10 to restrict an upward sliding movement of upper element 10 to prevent upper element 10 from coming off lower element 30.

Metal fixture 34 larger in diameter than lower element 30 is disposed at a lower end of lower element 30. Metal fixture 34 comes into contact with support 50 attached to housing 1 when the antenna is extended to function as a feeding metal fixture for supplying an RF signal to lower element 30.

In the antenna of the second embodiment, the lengths of rod conductor 15 and lower element 30 are set such that the rod antenna made up of rod conductor 15 and lower element 30 has an electric length substantially equal to a quarter wavelength at first resonant frequency ($f_L$) when the antenna is extended.

Support 50 is attached to housing 1 of a portable radio device in electrical connection with a transceiver of the portable radio device to function as a feeding contact for powering the whip antenna. In FIG. 3, the surface of housing 1 is indicated by a broken line. When the antenna is extended, support 50 is positioned below lower element 40 and comes into contact with metal fixture 43 to feed lower element 30. On the other hand, when the antenna is retracted, support 50 is positioned below coil element 11 and comes into contact with metal fixture 13 to feed coil element 11.

Next, description will be made on the operation of the antenna in the second embodiment. First described is the operation at first resonant frequency ($f_L$).

Figure 5:
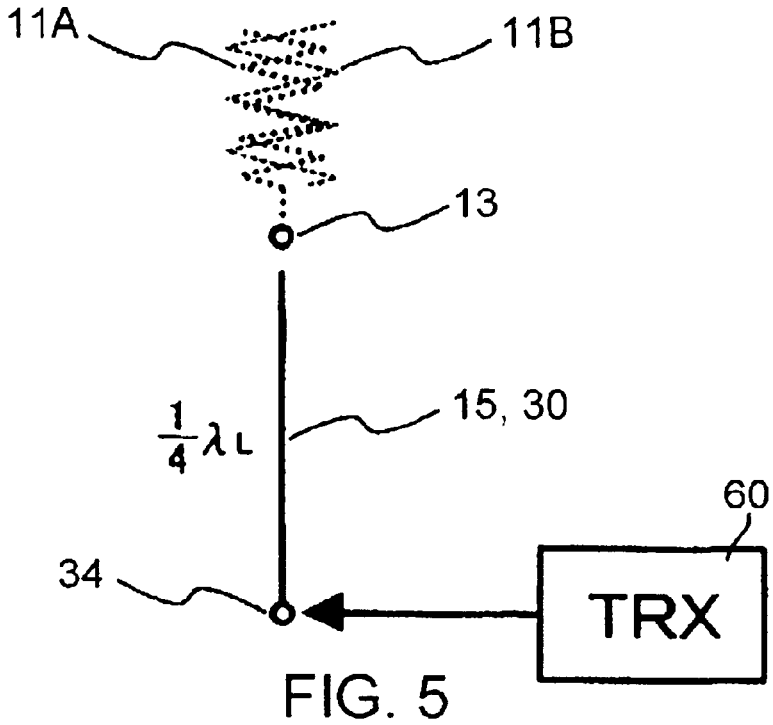
FIGS. 5 to 8 are equivalent circuit diagrams of the whip antenna illustrated in FIG. 3.

FIG. 5 shows that the antenna resonates at first resonant frequency ($f_L$) when it is extended. In this state, since antenna is extended, metal fixture 34 at the lower end of the antenna comes into contact with support 50 to connect with transceiver (TRX) 60 of the portable radio device. Then, the antenna is fed from the lower end of the rod antenna made up of rod conductor 15 and lower element 30, and the rod antenna resonates at first resonant frequency ($f_L$) with approximately a quarter wavelength ($\lambda_L/4$). The helical antenna (coil element 11) in turn is disposed on the rod antenna (rod conductor 15 and lower element 30), however, helical antenna 11 and rod antenna are insulated from each other by joint 14 and therefore electrically isolated, so that an RF current fed from the transceiver will not flow into coil element 11, causing coil element 11 to be inoperative when the antenna is extended.

Figure 6:
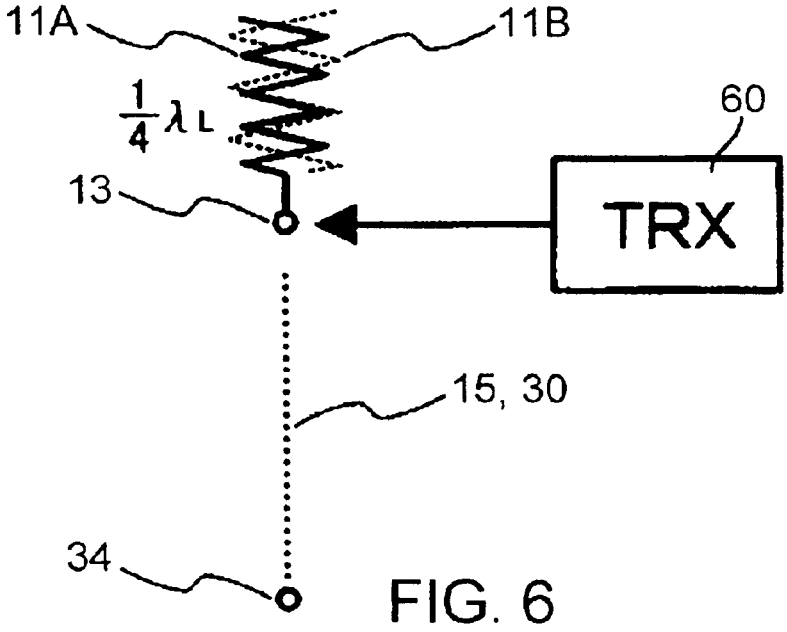

FIG. 6 in turn shows that the antenna resonates at first resonant frequency ($f_L$) when the antenna is retracted. In this state, since the antenna is retracted, metal fixture 13 below the helical antenna (coil element 11) comes into contact with support 50 to connect with transceiver 60. As a result, the helical antenna is fed, so that first coil element 11A disposed inside, within two coil elements 11A, 11B, is fed from its lower end to resonate at first resonant frequency ($f_L$) with approximately a quarter wavelength ($\lambda_L/4$). While second coil element 11B is disposed outside of first coil element 11A, second coil element 11B is designed to resonate at second resonant frequency ($f_H$), so that it has a larger impedance at first resonant frequency ($f_L$). Thus, at first resonant frequency ($f_L$), no sufficient RF current flows through second coil element 11B to cause the same to operate as a radiating conductor, so that second coil element 11B remains inoperative.

The rod antenna made up of rod conductor 15 and lower element 30, though disposed below the helical antenna (coil element 11), is insulated from helical antenna 11 by joint 14 and electrically isolated therefrom. Therefore, an RF current supplied from transceiver 60 will not flow into the rod antenna, so that the rod antenna is inoperative when the antenna is retracted.

Next, description will be made on the operation of the antenna at second resonant frequency ($f_H$) higher than first resonant frequency ($f_L$).

Figure 7:
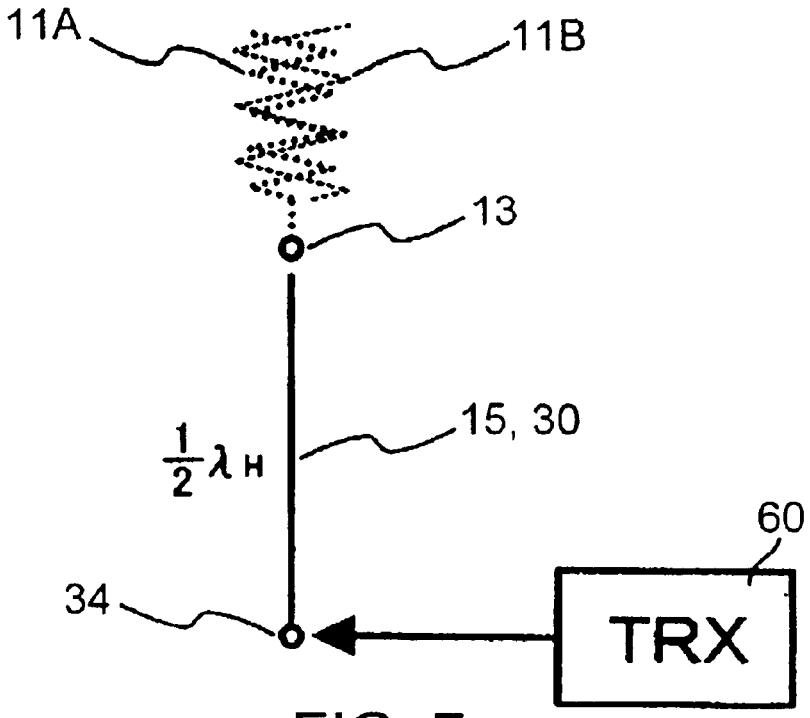

FIG. 7 shows that the antenna resonates at second resonant frequency ($f_H$) when it is extended. In this state, since the antenna is extended, metal fixture 34 at the lower end of the antenna comes into contact with support 50, thereby making a connection with transceiver 60. Then, the rod antenna made up of rod conductor 15 and lower element 30 is fed from its lower end, and resonates at second resonant frequency ($f_H$) with approximately a half wavelength ($\lambda_H/2$). Stated another way, in the second embodiment, second resonant frequency ($f_H$) is approximately twice as high as first resonant frequency ($f_L$), i.e., in a relationship expressed by $f_H \approx 2 \times f_L$.

The helical antenna (coil element 11) in turn is disposed on the rod antenna, but is insulated from the rod antenna by joint 14 and therefore electrically isolated therefrom, so that an RF current fed from the transceiver will not flow into coil element 11. Therefore, when the antenna is extended, the coil element 11 is inoperative as is the case with the resonating state at first resonant frequency ($f_L$) described above in connection with FIG. 5.

Figure 8:
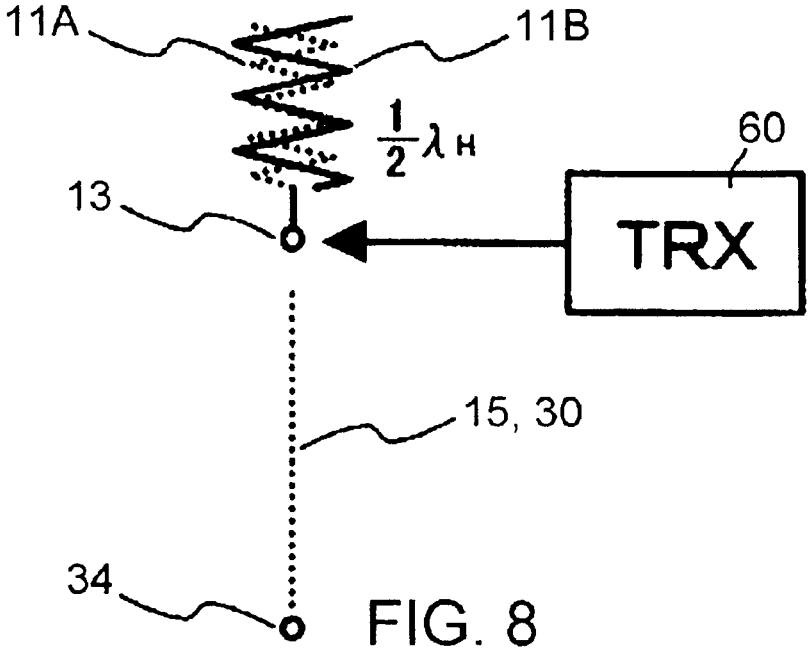

FIG. 8 in turn shows that the antenna resonates at second resonant frequency ($f_H$) when it is retracted. In this state, since the antenna is retracted, metal fixture 13 below the helical antenna (coil element 11) comes into contact with support 50 to connect with transceiver 60. This connection allows the helical antenna to be fed, so that second coil element 11B disposed outside, within two coil elements 11A, 11B, resonates at second resonant frequency ($f_H$) with approximately a half wavelength ($\lambda_H/2$). Second coil element 11B, though not directly connected to metal fixture 13, is coupled through capacitive coupling to first coil element 11A (indicated by a dotted line in FIG. 8) which is directly connected to metal fixture 13, so that an RF current supplied to metal fixture 13 is fed to second coil element 11B through first coil element 11A, causing second coil element 11B to operate at second resonant frequency ($f_H$). While first coil element 11A is disposed inside of second coil element 11B, first coil element 11A is designed to resonate at first resonant frequency ($f_L$), so that it has a larger impedance at second resonant frequency ($f_H$). Thus, no sufficient RF current flows through first coil element 11A to cause the same to operate as a radiating conductor, so that first coil element 11A remains inoperative.

The rod antenna made up of rod conductor 15 and lower element 30, though disposed below the helical antenna (coil element 11), is insulated from helical antenna 11 by joint 14 and electrically isolated therefrom. Therefore, an RF current supplied from transceiver 60 will not flow into the rod antenna, so that the rod antenna is inoperative when the antenna is retracted.

Figure 9:
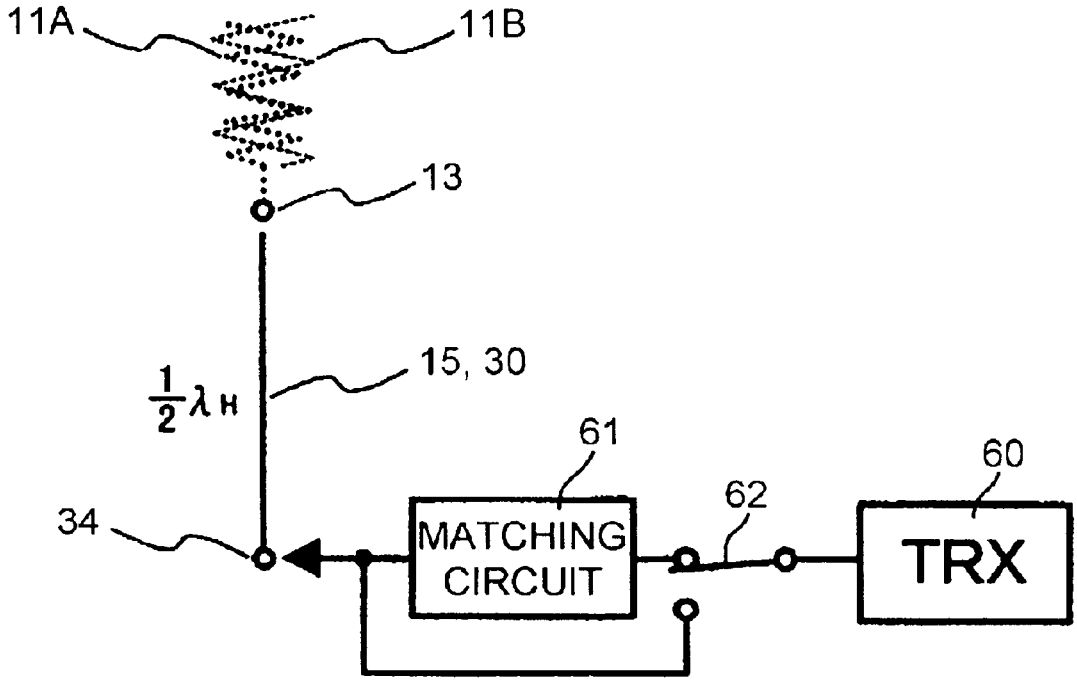
FIG. 9 is a block diagram illustrating an exemplary application of the whip antenna illustrated in FIG. 3.

The whip antenna in the second embodiment described above resonates at first resonant frequency ($f_L$) with approximately a quarter wavelength and resonates at second resonant frequency ($f_H$) higher than first resonant frequency ($f_L$) with approximately a half wavelength, so that the whip antenna has different antenna matching conditions at first resonant frequency ($f_L$) and second resonant frequency ($f_H$). Thus, in the second embodiment, matching circuit 61, which functions at second resonant frequency ($f_H$), is preferably disposed between the antenna and transceiver 60, as illustrated in FIG. 9, for changing the matching conditions for each frequency.

Specifically, change-over switch 62 disposed between transceiver 60 and matching circuit 61 is designed to connect transceiver 60 to the antenna not through matching circuit 61 at first resonant frequency ($f_L$) and to make such a connection through matching circuit 61 at second resonant frequency ($f_H$). By thus providing matching circuit 61 and change-over switch 62, this antenna is fed through matching circuit 61 which provides different matching conditions at second resonant frequency ($f_H$) from those at first resonant frequency ($f_L$), so that the antenna can be operated at appropriate matching conditions for each resonant frequency.

Also, in the whip antenna of the second embodiment, the helical antenna (coil element 11) operates when the antenna is retracted, and particularly, at second resonant frequency ($f_H$), second coil element 11B operates. Since this second coil element 11B resonates through an interaction with first coil element 11A, the antenna may have characteristics close to the impedance of a quarter-wave antenna, deviated from the impedance of a typical half-wave antenna, depending on the structure. When the impedance of the helical antenna is close to the impedance of a quarter-wave antenna at second resonant frequency ($f_H$) as mentioned above, change-over switch 61 disposed between transceiver 60 and matching circuit 61 is preferably designed to switch to matching circuit 61 at second resonant frequency ($f_H$) only when the antenna is extended. By thus designing change-over switch 61, the antenna is powered through matching circuit 61 at second resonant frequency ($f_H$) and only when the antenna is extended, and the antenna is connected directly to transceiver 60 in other situations, i.e., at first resonant frequency ($f_L$), and at second resonant frequency ($f_H$) when the antenna is retracted. Thus, the antenna can be operated under appropriate matching conditions for each resonant frequency even if the impedance of the rod antenna is not completely matched at second resonant frequency ($f_H$).

While preferred embodiments of the present invention have been described using specific terms, such description is for illustrative purposes only, and it is to be understood that changes and variations may be made without departing from the spirit or scope of the following claims.

What is claimed is:

1. An antenna comprising:

a first helical antenna element;

a second helical antenna element arranged coaxially with said first helical antenna element, and coupled to said first helical antenna element through capacitive coupling;

a connection directly connected only to said first helical antenna element for feeding said antenna, wherein said second helical antenna element is fed through said capacitive coupling, and further wherein said first helical antenna element is of a length causing it to resonate at a first resonant frequency with approximately a quarter wavelength, and said second helical antenna element is of a length causing it to resonate at a second resonant frequency with approximately a half wavelength.

2. The antenna according to claim 1, wherein said first helical antenna element is disposed inside of said second helical antenna element.

3. The antenna according to claim 1, wherein said connection is connected to said first helical antenna element at one end of said first helical antenna element, and said second helical antenna element is open at both ends thereof.

4. The antenna according to claim 3, wherein said first helical antenna element is disposed inside of said second helical antenna element.

5. The antenna according to claim 3, wherein said second helical antenna element resonates through an interaction with said first helical antenna element at said second resonant frequency different from said first resonant frequency.

6. The antenna according to claim 5, wherein said second resonant frequency is higher than said first resonant frequency.

7. The antenna according to claim 1, wherein said second helical antenna element resonates through an interaction with said first helical antenna element at said second resonant frequency different from said first resonant frequency.

8. An antenna comprising:

a rod antenna which can be at least partially retracted into a housing;

a helical antenna disposed at an upper end of said rod antenna and electrically insulated from said rod antenna; and a first connection disposed at a lower end of said rod antenna, wherein said helical antenna comprises:

a first helical antenna element;

a second helical antenna element arranged coaxially with said first helical antenna element, and coupled to said first helical antenna element through capacitive coupling; and a second connection directly connected only to said first helical antenna element for feeding said helical antenna, said antenna being fed through said first connection when said rod antenna is extended from said housing, and fed through said second connection when said rod antenna is retracted in said housing, said second helical antenna element being fed through said capacitive coupling, and further wherein said first helical antenna element is of a length causing it to resonate at a first resonant frequency with approximately a quarter wavelength, and said second helical antenna element is of a length causing it to resonate at a second resonant frequency with approximately a half wavelength.

9. The intern according to claim 8, wherein said first helical antenna element is disposed inside of said second helical antenna element.

10. The antenna according to claim 8, wherein said second connection is connected to said first helical antenna element at one end of said first helical antenna element, and said second helical antenna element is open at both ends thereof.

11. The antenna according to claim 10, wherein said first helical antenna element is disposed inside of said second helical antenna element.

12. The antenna according to claim 10, wherein said second helical antenna element resonates through an interaction with said first helical antenna element at said second resonant frequency different from said first resonant frequency.

13. The antenna according to claim 12, wherein said second resonant frequency is higher than said first resonant frequency.

14. The antenna according to claim 8, wherein said second helical antenna element resonates through an interaction with said first helical antenna element at said second resonant frequency different from said first resonant frequency.

15. The antenna according to claim 14, wherein said rod antenna resonates at said first resonant frequency with approximately a quarter wavelength.

16. The antenna according to claim 14, wherein said rod antenna resonates at said second resonant frequency with approximately a half wavelength.

17. The antenna according to claim 16, further comprising a matching circuit for providing a matching condition at said first resonant frequency, said matching condition being different from a matching condition at said first resonant frequency, wherein said rod antenna is fed at said second resonant frequency through said matching circuit.

18. The antenna according to claim 8, wherein said helical antenna disposed at an upper end of said rod antenna is directly attached to said upper end of said rod antenna via electrical insulation.

19. The antenna according to claim 18, wherein said electrical insulation comprises synthetic resin.

* * * * *